US008944933B2

(12) United States Patent
Helstrom

(10) Patent No.: US 8,944,933 B2
(45) Date of Patent: Feb. 3, 2015

(54) GOLF TRAINING DEVICE

(71) Applicant: Jeffrey Clifford Helstrom, Waconia, MN (US)

(72) Inventor: Jeffrey Clifford Helstrom, Waconia, MN (US)

( * ) Notice: Subject to any disclaimer, the term of this patent is extended or adjusted under 35 U.S.C. 154(b) by 0 days.

(21) Appl. No.: 13/707,356

(22) Filed: Dec. 6, 2012

(65) Prior Publication Data

US 2013/0143686 A1 Jun. 6, 2013

Related U.S. Application Data

(60) Provisional application No. 61/567,521, filed on Dec. 6, 2011.

(51) Int. Cl.
*A63B 69/36* (2006.01)

(52) U.S. Cl.
CPC ..... *A63B 69/3667* (2013.01); *A63B 69/3641* (2013.01)
USPC ..... 473/270; 473/262

(58) Field of Classification Search
USPC ..... 473/158, 218, 257, 262, 265, 270, 278; 273/108.21
See application file for complete search history.

(56) References Cited

U.S. PATENT DOCUMENTS

| | | | | | |
|---|---|---|---|---|---|
| 1,195,173 | A | * | 8/1916 | Beamer et al. | 273/118 R |
| 1,484,064 | A | * | 2/1924 | Taylor et al. | 473/218 |
| 1,875,198 | A | * | 8/1932 | Nagai | 473/20 |
| D157,950 | S | * | 4/1950 | Goldstein | D21/339 |
| 3,561,764 | A | * | 2/1971 | Thomas | 473/257 |
| 4,429,881 | A | * | 2/1984 | Barrett | 473/158 |
| 4,775,152 | A | * | 10/1988 | Roehl | 273/108.1 |
| D317,945 | S | * | 7/1991 | McNaull | D21/319 |
| 5,480,167 | A | * | 1/1996 | Johnson | 273/108.21 |
| D377,669 | S | * | 1/1997 | Walker | D21/358 |
| 5,893,805 | A | * | 4/1999 | Douglass | 473/218 |
| 5,980,351 | A | * | 11/1999 | McCook | 446/26 |
| 6,077,168 | A | * | 6/2000 | Huang | 473/218 |
| 7,927,228 | B2 | * | 4/2011 | Rhodes | 473/270 |

* cited by examiner

*Primary Examiner* — Nini Legesse
(74) *Attorney, Agent, or Firm* — Inskeep IP Group, Inc.

(57) ABSTRACT

A device that makes an imprint in a sand trap, providing a practicing golfer with visual indications of proper swing path, club face angle, club impact position, when making a basic sand shot.

14 Claims, 2 Drawing Sheets

GOLF TRAINING DEVICE

RELATED APPLICATIONS

This application claims priority to U.S. Provisional Application Ser. No. 61/567,521 filed Dec. 6, 2011 entitled Golf Training Device, which is hereby incorporated herein by reference in its entirety.

FIELD OF THE INVENTION

The invention relates to training devices for golf swings.

BACKGROUND OF THE INVENTION

There are hundred of swing trainers on the market. Unfortunately, swing trainers designed to teach a student how to make proper sand shots are almost non-existent. There exists a need for a device that can be used when learning how to perform golf shots from sand traps.

OBJECTS AND SUMMARY OF THE INVENTION

The invention provides a device that helps a golfer with alignment, club face angle, and proper club placement when hitting a golf ball out of the sand. The device makes an imprint in the sand that includes lines showing the golfer where to aim in relation to the flag, where the club should make initial contact with the sand relative to the ball, and how open the club face should be.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
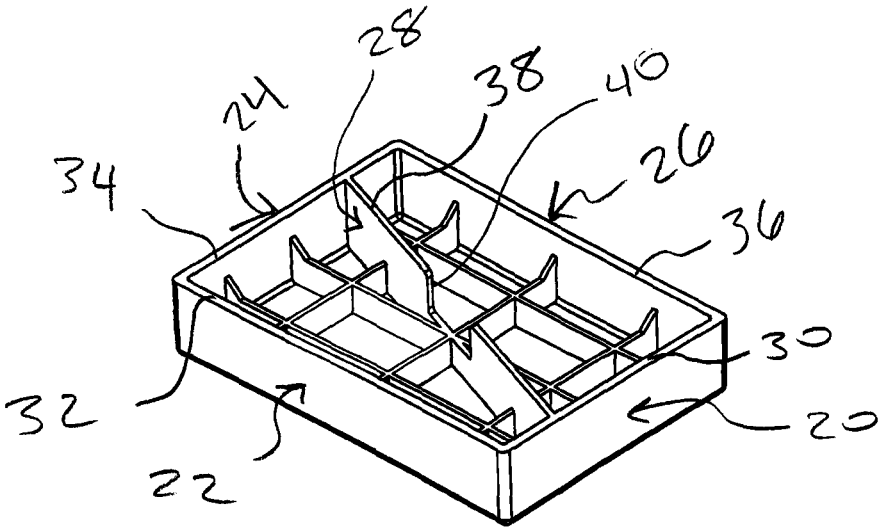
FIG. 1 is a perspective view of a bottom of an embodiment of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 2:
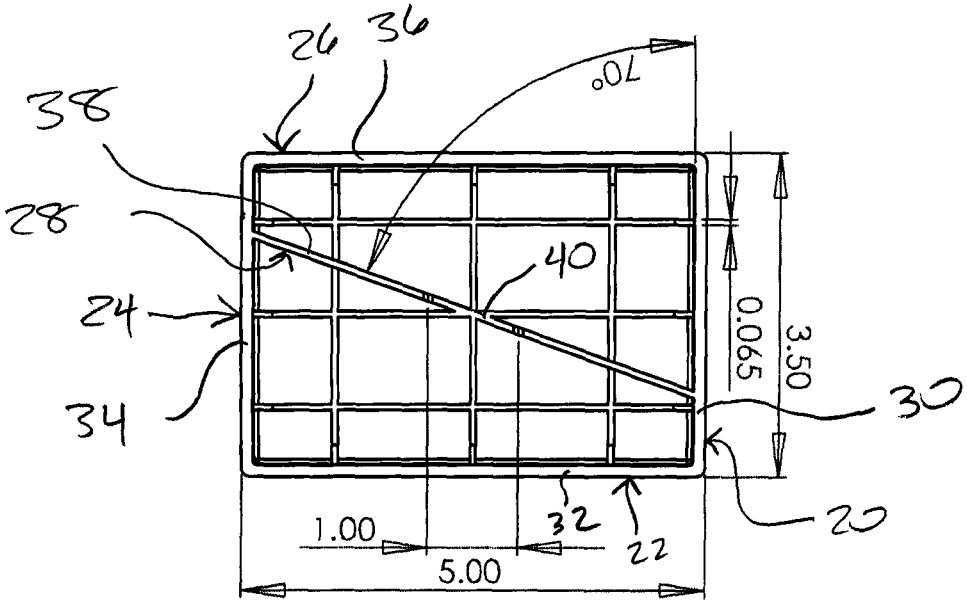
FIG. 2 is a plan view of a bottom of an embodiment of the invention.

FIGS. 1 and 2 show an embodiment 10 of the invention. The device 10 is a stamp used to make an imprint in the sand of a sand trap. The embodiment 10 includes an open box like structure having four walls 20, 22, 24, and 26 arranged in a rectangle. A diagonal wall 28 extends through the device 10 from wall 20 to wall 24. Each of the walls has an edge 30, 32, 34, 36 and 38, respectively that will make an imprint when the device 10 is pressed into sand. The diagonal edge 38 includes a feature 40 that gives an indication in the resulting imprint as to where the golf ball should be placed when using the imprint to practice a sand shot. The feature 40 is shown as an interruption in the edge 38 but may be a variety of other features such as an intersecting edge forming a cross-hair design, a protrusion, or any other feature that would result in a visible indicator in the resulting sand imprint as to where the ball should be located. FIG. 2 includes dimensions for an example of an embodiment of the invention.

Figure 3:
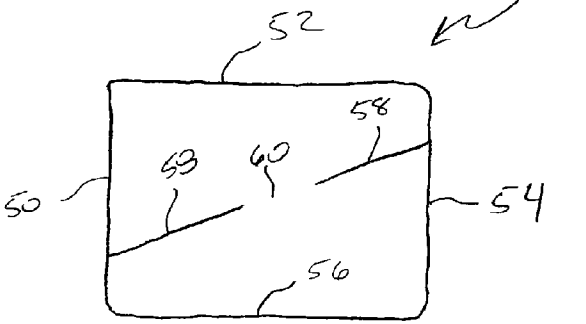
FIG. 3 is a depiction of a sand imprint made by an embodiment of the invention.

FIG. 3 shows a depiction of a sand imprint 100 made with the device 10. The imprint includes lines 50, 52, 54, 56, and 58 made by edges 40, 42, 44, 46, and 48 respectfully. Line 58 includes interruption 60 made by feature 40. When using the imprint, a ball should be placed on the interruption 60.

Figure 4:
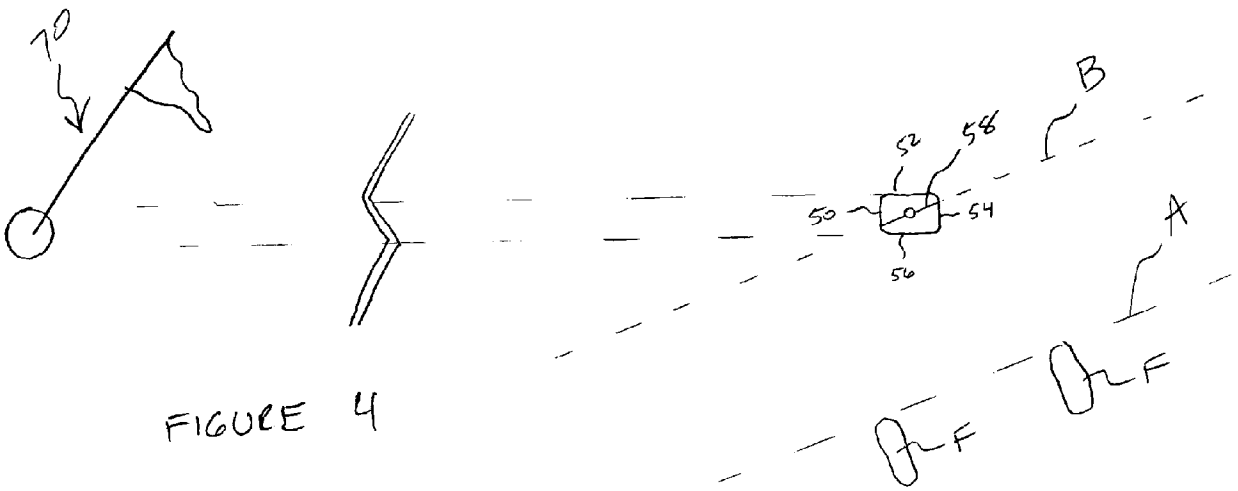
FIG. 4 is a diagram showing how an imprint made using an embodiment of the invention is used to align a golf shot.

FIG. 4 shows an example of how the imprint 100 is used. The golfer places his or her feet F on a line A that runs parallel to the line 58. The line 58 represents the desired club path, extended in the Figure as line B, when making the sand shot. Lines 56 and 52 should be aligned with the flag 70. Thus, the club path B is to the left of the flag 70, for a right handed golfer. The leading edge of the golf club should be parallel to the line 54. Thus the club is considered to be "open." When swinging, the line 54 indicates where the club should first strike the sand. This ensures the club passes under the ball, allowing the sand to lift the ball out of the trap.

Having described some embodiments of the invention, the versatility of the invention may be discussed. For example, in addition to using the device 10 to make imprints 100 in sand, edges 32 and 36 may be coated with a substance, such as chalk, and used to assist in putting training. After coating the edges 32 and 36, and perhaps 34 as well, with chalk, the device 10 may be used to stamp a putting surface, thereby creating parallel chalk lines to be used as a visual aid for putting.

Figure 5:
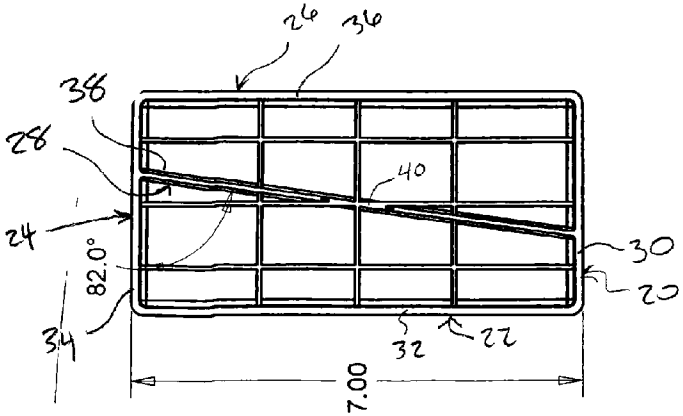
FIG. 5 is a plan view of a bottom of an embodiment of the invention.

Additionally, devices may be constructed having different dimensions for different shots. For example, FIG. 5 shows a device 10 having the same components as those shown in the other Figures, except that the dimensions differ from those dimensions shown in FIG. 2. Altering these dimensions creates shots with slightly different ball flights. Additionally, it is to be understood that all of the embodiments shown in the figures are designed for right-handed golfers. Left-handed embodiments would simply be mirror-images of these embodiments. Another example of a variation of the device 10 would be a diagonal wall 28 that is adjustable such that it could be set at different angles for different shots.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A golf training device comprising:

a plurality of outer walls connected on an upper side by an upper surface and having vertical bottom edges, said bottom edges constructed and arranged to form a rectangle; and, at least one angled inner wall extending downwardly from said upper surface and having a vertical bottom edge, said at least one angled inner wall oriented such that said at least one angled inner wall is not parallel to said outer walls;

such that, when pressed into a bunker and removed, said bottom edges create a pattern in sand of said bunker showing stance alignment and swing line, said pattern approximating an area of sand displaced by a golf club during a correctly-executed bunker shot.

2. The golf training device of claim 1 wherein said at least one angled inner wall comprises two angled inner walls separated by a distance approximately equal to a diameter of a golf ball.

3. The golf training device of claim 2 wherein said two angled inner walls are coplanar.

4. The golf training device of claim 1 wherein said upper surface is not continuous.

5. The golf training device of claim 1 wherein said upper surface is continuous.

6. A golf training device for making an imprint in sand comprising:

a rectangular box having an open bottom;

at least one angled inner wall within said rectangular box oriented such that it is not parallel to outer walls of said rectangular box;

said box sized to create a pattern in a bunker having an area approximating an area of sand displaced by a golf club during a correctly-executed bunker shot.

7. The golf training device of claim 6 wherein said rectangular box comprises a top surface.

8. The golf training device of claim 6 wherein said at least one angled vertical wall comprises two angled vertical walls oriented to form a gap between said two angled vertical walls, said gap having a horizontal dimension approximately equal to a diameter of a golf ball.

9. The golf training device of claim 6 wherein said at least one angled inner wall comprises a bottom edge.

10. The golf training device of claim 9 wherein said bottom edge comprises a feature having a length approximately equal to a diameter of a golf ball.

11. The golf training device of claim 10 wherein said feature is approximately centered horizontally in one of said at least one angled inner walls.

12. A stamp for making an impression in a golfing sand trap comprising:

a plurality of outer walls having bottom edges;

at least one angled inner wall having a bottom edge;

wherein said bottom edges of said walls are arranged, such that when pressed into sand of a sand trap, said bottom edges create a rectangle having a line passing therethrough, wherein said line is not parallel to any side of said rectangle;

said rectangle having an area approximating an area of sand displaced by a golf club during a correctly-executed bunker shot.

13. The stamp of claim 12 wherein said line comprises an interruption.

14. The stamp of claim 13 wherein said interruption has a dimension approximately equal to a diameter of a golf ball.

* * * * *